US011618072B2

(12) United States Patent
Miyazaki et al.

(10) Patent No.: US 11,618,072 B2
(45) Date of Patent: Apr. 4, 2023

(54) THIN STRIP MANUFACTURE METHOD

(71) Applicant: NIPPON STEEL CORPORATION, Tokyo (JP)

(72) Inventors: Masafumi Miyazaki, Tokyo (JP); Takeaki Wakisaka, Tokyo (JP); Takashi Arai, Tokyo (JP); Naotsugu Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/054,977

(22) PCT Filed: May 27, 2019

(86) PCT No.: PCT/JP2019/020853
§ 371 (c)(1),
(2) Date: Nov. 12, 2020

(87) PCT Pub. No.: WO2019/239868
PCT Pub. Date: Dec. 19, 2019

(65) Prior Publication Data

US 2021/0213515 A1 Jul. 15, 2021

(30) Foreign Application Priority Data

Jun. 12, 2018 (JP) ..... JP2018-111919

(51) Int. Cl.
*B22D 11/16* (2006.01)
*B22D 11/06* (2006.01)

(52) U.S. Cl.
CPC ..... *B22D 11/16* (2013.01); *B22D 11/0622* (2013.01); *B22D 11/0682* (2013.01)

(58) Field of Classification Search
CPC ..... B22D 11/0622
See application file for complete search history.

(56) References Cited

U.S. PATENT DOCUMENTS

2005/0217822 A1 10/2005 Miyazaki et al.
2009/0236067 A1* 9/2009 Rees ..... B22D 11/0622 164/452
2009/0288798 A1* 11/2009 Ondrovic ..... B21B 45/0218 164/463

FOREIGN PATENT DOCUMENTS

| | | | |
|---|---|---|---|
| JP | H02-63650 | A | 3/1990 |
| JP | H02-92438 | A | 4/1990 |
| JP | H03-198950 | A | 8/1991 |
| JP | 2003-285141 | A | 10/2003 |
| JP | 2017-131933 | A | 8/2017 |
| KR | 20040020463 | A * | 3/2004 |

* cited by examiner

*Primary Examiner* — Kevin E Yoon
*Assistant Examiner* — Jacky Yuen
(74) *Attorney, Agent, or Firm* — Myers Wolin, LLC

(57) ABSTRACT

This thin strip manufacture method is a thin strip manufacture method for manufacturing a thin strip by supplying molten steel to a molten steel pool formed by a pair of rotating cooling drums and a pair of side weirs to form and grow a solidified shell on a peripheral surface of the cooling drums, wherein a pressing force P of the pair of the cooling drums is set so that the pressing force P (kgf/mm) of the pair of cooling drums, casting thickness D (mm), and radius R (m) of the cooling drums satisfy $0.90 \leq P \times (D \times R)^{0.5} \leq 1.30$.

4 Claims, 4 Drawing Sheets

THIN STRIP MANUFACTURE METHOD

CROSS-REFERENCE TO RELATED APPLICATION

This application is a national stage application of International Application No. PCT/JP2019/020853, filed on May 27, 2019 and designated the U.S., which claims priority to Japanese Patent Application No. 2018-111919, filed on Jun. 12, 2018. The contents of each are herein incorporated by reference.

TECHNICAL FIELD

The present disclosure relates to a thin strip manufacture method for manufacturing a thin strip by supplying molten steel to a molten steel pool formed by a pair of cooling drums and a pair of side weirs to manufacture a thin strip.

The present application claims priority based on Japanese Patent Application No. 2018-111919 filed in Japan on Jun. 12, 2018, and the content thereof is incorporated herein.

RELATED ART

As a device for manufacturing a thin strip of metal, there is provided a twin drum type continuous casting device including a pair of cooling drums having a water cooling structure inside and rotating in opposite directions in which molten steel is supplied to a molten steel pool formed by a pair of cooling drums and a pair of side weirs, a solidified shell is formed and grown on the peripheral surface of the cooling drums, and the solidified shells formed on the outer peripheral surfaces of the pair of cooling drums are press-bonded to each other at a drum kiss point to manufacture a thin strip having a predetermined thickness. Such a twin drum type continuous casting device is applied to various metals.

In the twin drum type continuous casting device described above, for example, as shown in Patent Document 1, molten steel is continuously supplied from a tundish arranged above the cooling drums to the molten steel pool through an immersion nozzle, the molten steel solidifies and grows on the peripheral surface of the rotating cooling drums to form a solidified shell, and the solidified shells formed on the peripheral surface of each cooling drum are press-bonded at a drum kiss point to manufacture and output a thin strip.

By the way, in the thin strip manufactured by using the twin drum type continuous casting device described above, since the molten steel is rapidly cooled during solidification, the solidified structure has a columnar crystal from the surface layer of both surfaces toward the ½ thickness part. Depending on the type of steel and casting conditions, equiaxed crystals may be formed in the ½ thickness part.

Conventionally, generally, for example, as shown in Patent Document 1, in order to homogenize a metal structure, it has been aimed to positively generate equiaxed crystals.

Further, in Patent Document 2, in a method of casting an austenitic stainless steel thin strip slab by a continuous casting device in which a mold wall moves in synchronization with the slab, a manufacture method is proposed in which the generation of Ni negative segregation is suppressed by controlling the pressing force of the mold wall surface and spots and staggered arrangement of marbling-like gloss unevenness shown in a steel sheet after cold rolling and cold working are prevented.

CITATION LIST

[Patent Document]

[Patent Document 1]

Japanese Unexamined Patent Application, First Publication No. H02-092438

[Patent Document 2]

Japanese Unexamined Patent Application, First Publication No. 2003-285141

SUMMARY

Problems to be Solved

By the way, when the solidified shells are press-bonded to each other with the equiaxed crystal sandwiched therebetween, the liquid phase trapped between the particles may be solidified and shrunk to generate micropores. Micropores are pores with a diameter of about 300 μm to 100 μm, and act as a fracture starting point during processing, which adversely affects mechanical properties such as strength and toughness.

On the other hand, when the solidified shells including columnar crystals are press-bonded to each other, the liquid phase is discharged and the columnar crystals adhere to each other, so that micropores do not occur. Therefore, from the viewpoint of preventing deterioration of mechanical properties due to micropores, a thin strip having a low equiaxed crystal ratio and a high columnar crystal ratio is desired.

In a thin strip manufactured using the twin drum type continuous casting device, even if an attempt is made to increase the columnar crystal ratio overall, the production situation of equiaxed crystals is not stable and in some cases a portion is generated in which the equiaxed crystal ratio locally becomes 5% or more, and the columnar crystal ratio becomes less than 95%.

When a defect portion due to micropores occurs in a thin strip that is continuously cast, as a countermeasure against this, it is necessary to further add hot rolling to the thin strip and press-bond the micropores. Due to the increase in the number of steps, the production efficiency will be significantly reduced. Therefore, a thin strip having a high columnar crystal ratio and stable over the entire area has been desired.

The present disclosure has been made in view of the above-mentioned situation, and an object is to provide a thin strip manufacture method capable of stably manufacturing a thin strip with a high columnar crystal ratio over the entire area of the strip.

Means for Solving the Problem

An aspect of the present disclosure is a thin strip manufacture method for manufacturing a thin strip by supplying molten steel to a molten steel pool formed by a pair of rotating cooling drums and a pair of side weirs to form and grow a solidified shell on a peripheral surface of the cooling drums, wherein a pressing force P of the pair of the cooling drums is set so that the pressing force P (kgf/mm) of the pair of cooling drums, casting thickness D (mm), and radius R (m) of the cooling drums satisfy $0.90 \leq P \times (D \times R)^{0.5} \leq 1.30$.

In the thin strip manufacture method configured as described above, $P \times (D \times R)^{0.5}$ defined by the pressing force P of the cooling drum, the casting thickness D (mm), and the radius R (m) of the cooling drum is 1.30 or less, and it is possible to prevent the pressing force P of the drum from becoming excessively high and to suppress the generation and growth of equiaxed crystals. Therefore, it is possible to manufacture a thin strip that stably has a small number of equiaxed crystals across the entire area.

On the other hand, since $P\times(D\times R)^{0.5}$ is 0.90 or more, the solidified shells can be reliably press-bonded to each other, and a thin strip can be stably manufactured.

Further, since the pressing force P of the pair of cooling drums is set in consideration of the casting thickness D (mm) and the radius R (m) of the cooling drum, it is possible to stabilize the actual pressing situation.

Effects

As described above, according to the present disclosure it is possible to provide a thin strip manufacture method capable of stably manufacturing a thin strip having a high columnar crystal ratio over the entire area of the strip.

DETAILED DESCRIPTION

Figure 1:
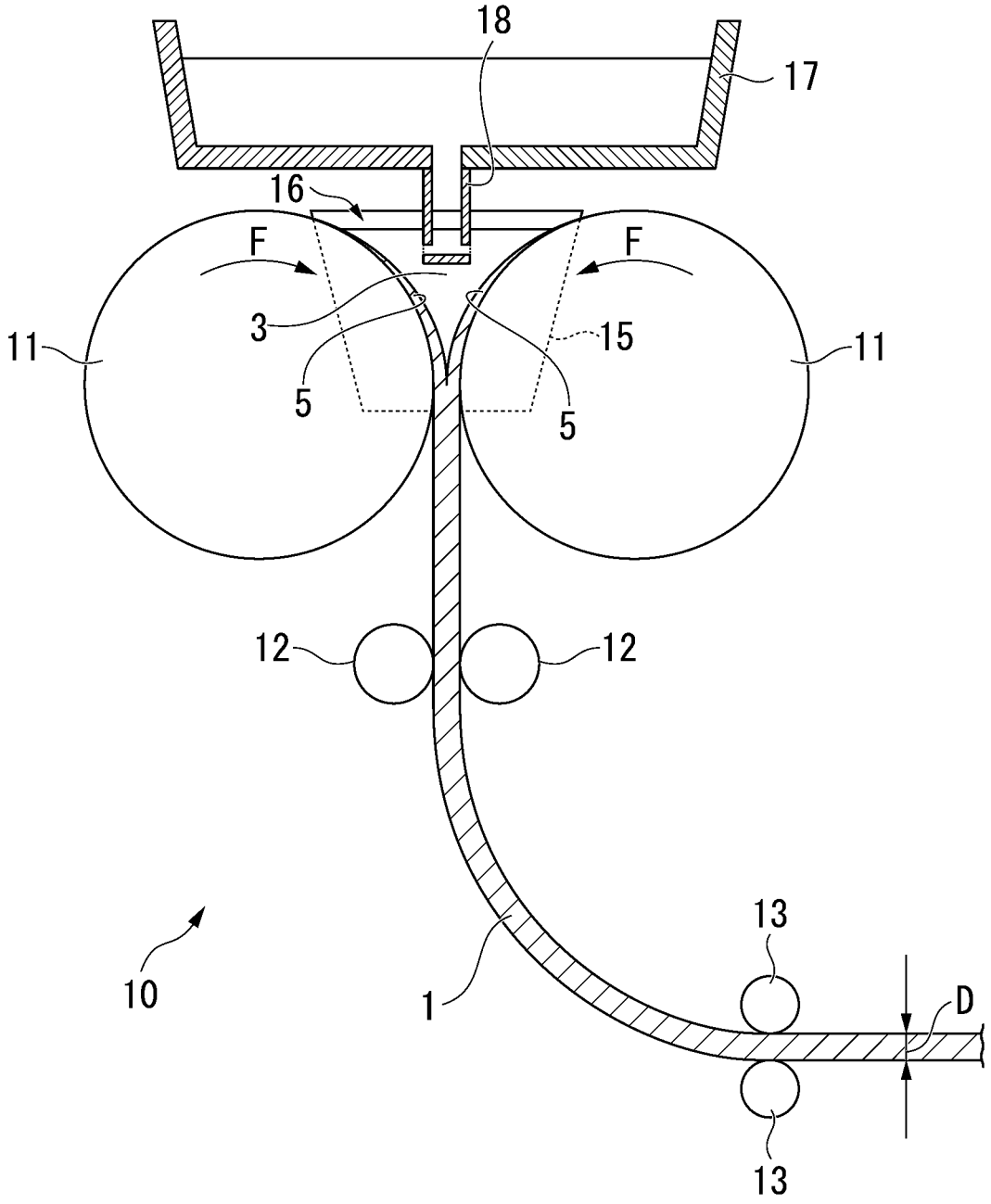
FIG. 1 is a schematic explanatory view of a twin drum type continuous casting device used when carrying out a thin strip manufacture method which is an embodiment of the present disclosure.

In order to solve the above-mentioned problem, as a result of diligent studies by the present inventors, it was confirmed that a twin drum type continuous casting device has the following two mechanisms for generating equiaxed crystals.

(1) A solidification nuclei generated at the contact portion (meniscus) between molten steel and a drum surface is separated from the drum surface by the molten steel flow to become crystal nuclei, and moves to a lower part of the molten steel pool as the drum rotates. Here, when the pressing force of the pair of cooling drums exceeds a certain value, the crystal nuclei are retained by press-bonding and drawing up of the solidified shells due to pressing of the cooling drums, and the crystal nuclei coalesce and grow to be involved between the solidified shells so as to be equiaxed crystals.

(2) When the pressing force is excessive when the solidified shells are press-bonded by the pressing of the cooling drums, the tip of the solidified shells is broken by the rolling reduction, and a crystal nucleus is generated. Then, the crystal nuclei are retained by press-bonding and drawing up of the solidified shells due to pressing of the cooling drums, and the crystal nuclei coalesce and grow to be involved between the solidified shells so as to be equiaxed crystals.

As described above, in the mechanism for generating equiaxed crystals, the factor that promotes the generation and growth of equiaxed crystals is excessive press-bonding of the solidified shells by pressing of the cooling drums, and it was found that the generation and growth of equiaxed crystals can be suppressed by optimizing the pressing situation of the cooling drums.

Here, when the outer diameter (drum diameter) of the cooling drum is large, the press-bonding of the solidified shells becomes closer to the compression of a flat plate, and the drawing up and breakage due to the press-bonding become more excessive. Therefore, when the drum diameter is large, it is necessary to keep the pressing force of the drum low.

Further, when the solidified shell thickness corresponding to the casting thickness is large, the peripheral speed of the cooling drum becomes slower, and a large number of free crystal nuclei are generated. Moreover, since the temperature gradient at the interface between the solidified shell and the molten steel becomes smaller and a brittle portion at the tip of the solidified shell becomes thicker, breakage due to pressing becomes excessive. Therefore, when the solidified shell thickness (i.e., casting thickness) is large, it is necessary to keep the pressing force of the drum low.

The thin strip manufacture method, which is an embodiment of the present disclosure made on the basis of the above knowledge will be described with reference to the accompanying drawings. Note that the present disclosure is not limited to the embodiment below.

A thin strip 1 manufactured in the present embodiment may be used for automobile steel sheets (steel plates), corrosion-resistant/weather-resistant steel plates, welded pipes, oriented electrical steel sheets, non-oriented electrical steel sheets, and the like.

Further, in the present embodiment, the width of the thin strip 1 to be manufactured is within the range of 300 mm or more and 2000 mm or less, and the thickness is within the range of 1 mm or more and 5 mm or less.

A twin drum type continuous casting device 10 in the present embodiment includes, as shown in FIG. 1, a pair of cooling drums 11, 11, bender rolls 12, 12 for bending the thin strip 1, pinch rolls 13, 13 for supporting the thin strip 1, side weirs 15 arranged at the widthwise ends of the pair of cooling drums 11, 11, a tundish 17 for holding a molten steel 3 supplied to a molten steel pool 16 defined by the pair of cooling drums 11, 11 and the side weirs 15, and an immersion nozzle 18 for supplying the molten steel 3 from the tundish 17 to the molten steel pool 16.

Figure 2:
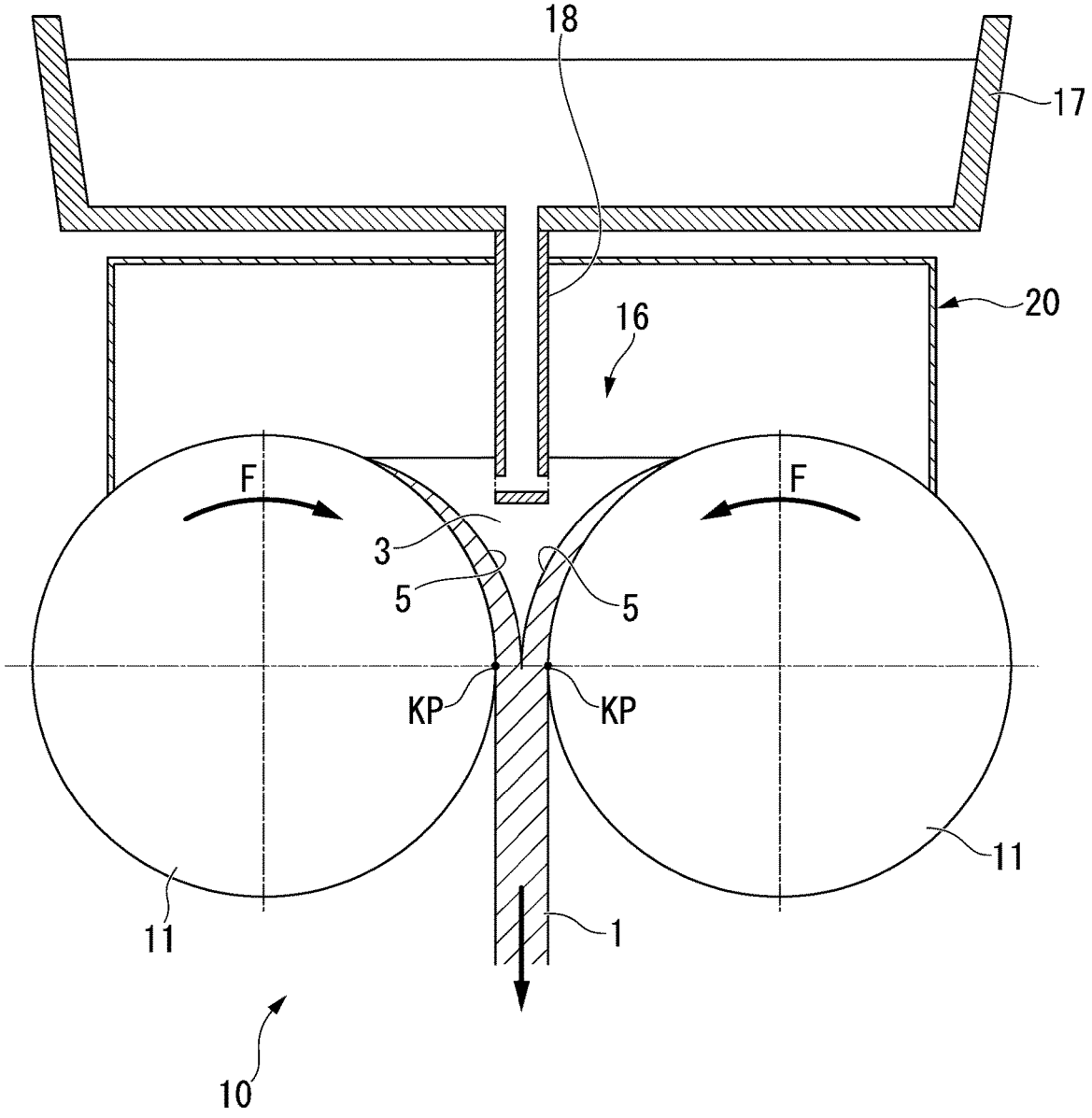
FIG. 2 is an enlarged explanatory view of the twin drum type continuous casting device shown in FIG. 1.

FIG. 2 shows an enlarged explanatory view around the molten steel pool 16 in FIG. 1. In the twin drum type continuous casting device 10 according to the present embodiment, as shown in FIG. 2, a chamber 20 is arranged above the molten steel pool 16 and the cooling drums 11, 11.

Next, the thin strip manufacture method according to the present embodiment using the twin drum type continuous casting device 10 described above will be described.

The molten steel 3 is supplied from the tundish 17 through the immersion nozzle 18 to the molten steel pool 16 formed by the pair of cooling drums 11, 11 and the side weirs 15, and the cooling drums 11, 11 are rotated so that the pair of cooling drums 11, 11 rotate in the rotation direction F, i.e., a region where the pair of cooling drums 11, 11 are close to each other is directed toward the removal direction (the downward direction in FIG. 1) of the thin strip 1.

Then, the solidified shell 5 is formed on the peripheral surface of the cooling drums 11. Then, the solidified shell 5 grows on the peripheral surface of the cooling drums 11, and the solidified shells 5, 5 formed on the pair of cooling drums 11, 11 are press-bonded to each other at a drum kiss point KP, and a thin strip 1 having a predetermined thickness is cast.

Further, in the present embodiment, the pressing force P (kgf/mm) at the drum kiss point KP between the pair of cooling drums 11, 11 is specified using a casting thickness D (mm) and a radius R (m) of the cooling drum 11 as described below.

$$0.90 \leq P \times (D \times R)^{0.5} \leq 1.30$$

Here, the reason why the pressing force P between the pair of cooling drums 11, 11 is specified as described above will be described.

Figure 3:
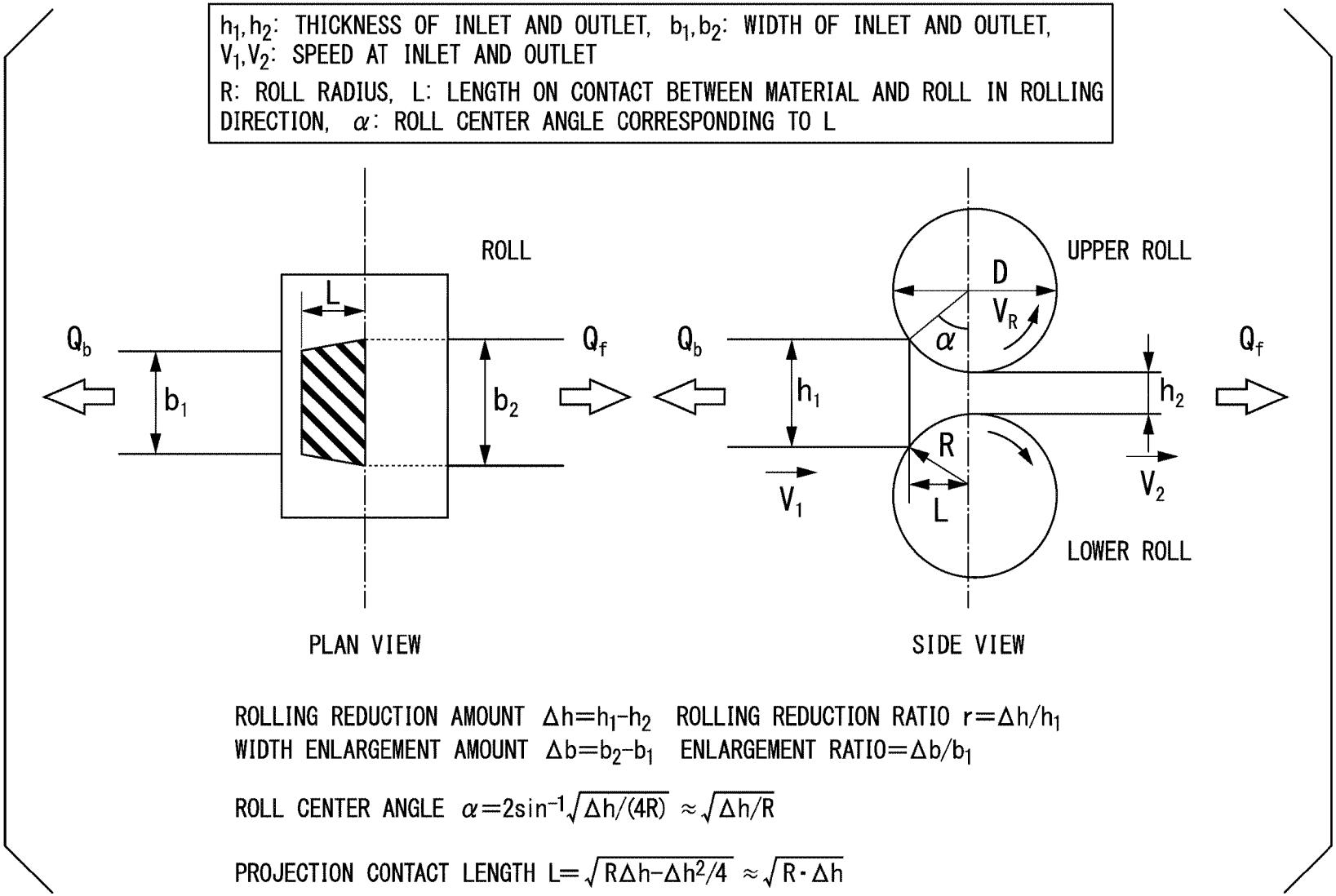
FIG. 3 is a diagram explaining the relationship between the contact length between a rolling roll and a rolled material, the radius of the rolling roll, and the amount of reduction in the thickness of the rolled material due to rolling in rolling with the rolling roll.

In general, in the theory of rolling, in the case of rolling with a rolling roll, as shown in FIG. 3, the relationship between the contact length L of the roll and the rolled material, the rolling roll radius R, and the reduction amount Δh of the sheet thickness due to rolling is represented by $$L = (\Delta h \times R)^{0.5}.$$

Here, as $(\Delta h \times R)^{0.5}$ increases, the contact length L increases even when pushed with the same rolling reduction force, and rolling efficiency increases, and thus in order to keep the rolling reduction state constant, it is necessary to reduce the pressing force according to the increase of $(\Delta h \times R)^{0.5}$.

In the twin drum type continuous casting device 10 of the present embodiment, the reduction amount Δh of the sheet thickness due to rolling is approximately proportional to the casting thickness D. Further, the radius R of the rolling roll corresponds to the radius R of the cooling drum 11. Therefore, in the twin drum type continuous casting device 10 of the present embodiment, an index indicating the degree of press-bonding of the solidified shells 5 or the degree of breakage of the solidified shell 5 that leads to the formation of equiaxed crystals is indicated by a product $P \times (D \times R)^{0.5}$ of the pressing force P and $(D \times R)^{0.5}$. Then, in order to stably suppress the generation and growth of equiaxed crystals over the entire area, and to firmly press-bond the solidified shells 5, 5 to each other, an appropriate range of $P \times (D \times R)^{0.5}$ described above is specified.

Here, when $P \times (D \times R)^{0.5}$ exceeds 1.30, the pressing between the cooling drums 11, 11 is excessive, and the tip of the solidified shell 5 is broken. Further, the crystal nuclei floating in the molten steel pool 16 are retained by press-bonding and drawing up of the solidified shells 5 due to pressing of the cooling drums 11, and the crystal nuclei coalesce and grow to be involved between the solidified shells 5, 5 so that equiaxed crystals can be generated and grown.

That is, by controlling the pressing force P using $(D \times R)^{0.5}$ which is the route of the product of the drum radius R (mm) and the casting thickness D (mm) as an index, the way of transmission of the force to the solidified shells 5, 5 at the drum kiss point KP can be appropriate, and the generation and growth of equiaxed crystals can be suppressed.

On the other hand, when $P \times (D \times R)^{0.5}$ is less than 0.90, the solidified shells 5, 5 may not be sufficiently press-bonded.

From the above, in the present embodiment, $P \times (D \times R)^{0.5}$ is set within the range of 0.90 or more and 1.30 or less.

Note that in order to further suppress the generation and growth of equiaxed crystals, the upper limit of $P \times (D \times R)^{0.5}$ is preferably set to 1.1 or less.

In the thin strip 1 manufactured by the thin strip manufacture method of the present embodiment having such a configuration, in a case where every 10 rotations of the cooling drum 11 (for example, when the radius R of the cooling drum 11 is 0.3 m, 18.8 m pitch) over the entire area of the thin strip 1, the whole width of the thin strip 1 is sampled and when the metallographic structure of the cross section in the width direction excluding 20 mm at each end, which is the trim margin, is observed, the minimum value of the ratio of the columnar crystal thickness to the thickness of the thin strip 1 is over 95%.

In the thin strip manufacture method according to the present embodiment configured as described above, $P \times (D \times R)^{0.5}$ defined by the pressing force P of the cooling drum 11, the casting thickness D (mm), and the radius R (m) of the cooling drum 11 is 1.30 or less, and it is possible to prevent the pressing force P of the cooling drum 11 from becoming excessively high and to suppress the generation and growth of equiaxed crystals. On the other hand, since $P \times (D \times R)^{0.5}$ is 0.90 or more, the solidified shells 5, 5 can be reliably press-bonded to each other.

Further, since the pressing force P of the pair of cooling drums 11, 11 is set in consideration of the casting thickness D (mm) and the radius R (m) of the cooling drum 11, it is possible to stabilize the actual pressing situation.

Therefore, it is possible to stably manufacture the thin strip 1 that has a small number of equiaxed crystals across the entire area of the thin strip 1.

Further, the thin strip 1 manufactured by the thin strip manufacture method according to the present embodiment has, as described above, the minimum value of the ratio of the columnar crystal thickness to the thickness of the thin strip 1 of more than 95%, and therefore it is possible to prevent the deterioration of mechanical properties due to the micropores.

Although the method for manufacturing the thin strip 1 according to the embodiment of the present disclosure has been specifically described above, the present disclosure is not limited to this and can be appropriately changed without departing from the technical idea of the disclosure.

For example, in the present embodiment, as shown in FIG. 1, the twin drum type continuous casting device in which the bender rolls and the pinch rolls are arranged has been described as an example, but the arrangement of these rolls is not limited, and the design may be changed as appropriate.

EXAMPLE

The results of experiments conducted to confirm the effects of the present disclosure will be described below.

Example 1

Using the twin drum type continuous casting device described in the embodiment, a thin strip including a steel containing C; 0.02 mass %, Si; 3.5 mass %, Al; 0.6 mass %, Mn; 0.2 mass % was cast under the conditions shown in Table 1. Note that the drum width was 400 mm.

Figure 4:
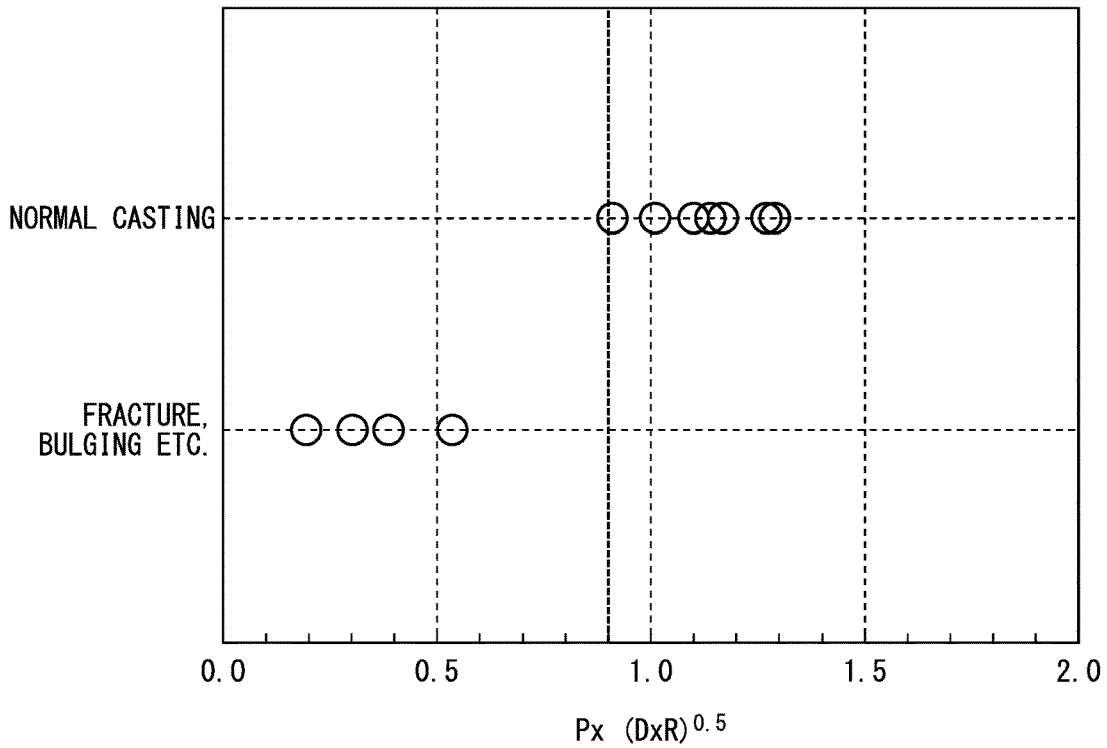
FIG. 4 is a graph showing results of evaluation of casting situations in an example.

First, the casting situation was visually evaluated. The evaluation results are shown in Table 1 and FIG. 4.

Figure 5:
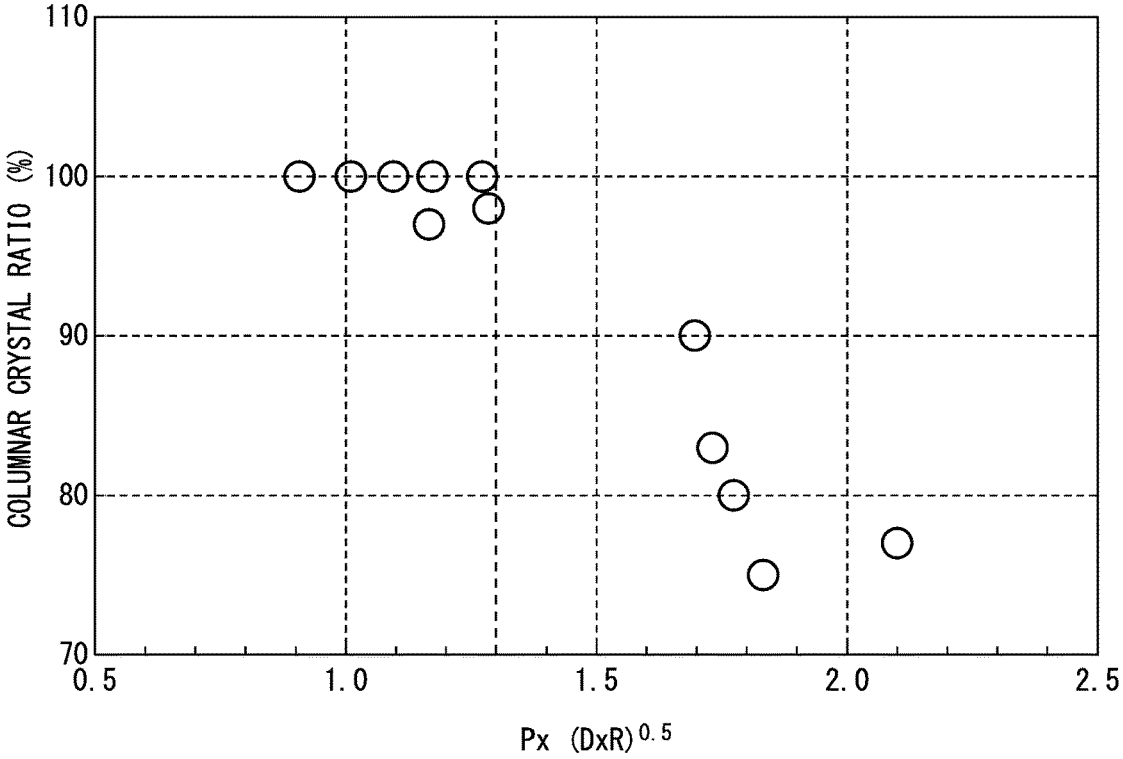
FIG. 5 is a graph showing results of evaluation of a columnar crystal ratio in an example.

Then, the columnar crystal ratio of the obtained thin strip was measured. In a case where every 10 rotations of the cooling drum (for example, when the radius R of the cooling drum is 0.3 m, 18.8 m pitch) over the entire area of the thin strip, the whole width of the thin strip was sampled and the metallographic structure of the cross section in the width direction excluding 20 mm at each end, which is the trim margin, was observed, and the minimum value of the ratio of the columnar crystal thickness to the thickness was the columnar crystal ratio of casting. The evaluation results are shown in Table 1 and FIG. 5.

Furthermore, Table 1 shows the average size and number density of micropores. From the thin strip, the full width was sampled over the length of one rotation of the cooling drum, and an X-ray transmission photograph was taken from the plate surface direction of the thin strip. Then, two-dimensional image processing was performed on the micropores observed as blank areas, and the average size (μm) and number density (number/$m^2$) of the micropores were measured.

TABLE 1

| | | Casting thickness D (mm) | Cooling drum radius R (m) | Pressing force P (kgf/mm) | $P \times (D \times R)^{0.5}$ | Casting speed (m/min) | Casting situation | Columnar crystal ratio (%) | Micropore average size (gm) | Micropore number density (number/$m^2$) |
|---|---|---|---|---|---|---|---|---|---|---|
| Inventive Example | 1 | 1.4 | 0.30 | 1.4 | 0.91 | 153 | Normal | 100 | (None) | (None) |
| | 2 | 1.4 | 0.30 | 1.8 | 1.17 | 153 | Normal | 97 | (None) | (None) |
| | 3 | 1.7 | 0.25 | 1.8 | 1.17 | 87 | Normal | 100 | (None) | (None) |
| | 4 | 1.7 | 0.30 | 1.8 | 1.29 | 104 | Normal | 98 | (None) | (None) |
| | 5 | 1.7 | 0.60 | 1.0 | 1.01 | 153 | Normal | 100 | (None) | (None) |
| | 6 | 2.0 | 0.25 | 1.8 | 1.27 | 63 | Normal | 100 | (None) | (None) |
| | 7 | 2.0 | 0.60 | 1.0 | 1.10 | 110 | Normal | 100 | (None) | (None) |
| | 8 | 3.0 | 0.30 | 1.2 | 1.14 | 31 | Normal | 100 | (None) | (None) |
| Comparative Example | 1 | 1.4 | 0.30 | 0.3 | 0.19 | 129 | Strip end missing | — | — | — |
| | 2 | 2.0 | 0.30 | 0.5 | 0.39 | 50 | Strip end missing | — | — | — |
| | 3 | 1.7 | 0.60 | 0.3 | 0.30 | 174 | Bulging fracture | — | — | — |
| | 4 | 3.0 | 0.60 | 0.4 | 0.54 | 56 | Bulging fracture | — | — | — |
| | 5 | 1.4 | 0.25 | 3.0 | 1.77 | 128 | Normal | 80 | 155 | 398 |
| | 6 | 1.4 | 0.35 | 3.0 | 2.10 | 161 | Normal | 77 | 255 | 988 |
| | 7 | 1.4 | 0.60 | 2.0 | 1.83 | 245 | Normal | 75 | 270 | 1403 |
| | 8 | 2.0 | 0.25 | 2.4 | 1.70 | 63 | Normal | 90 | 105 | 252 |
| | 9 | 3.0 | 0.25 | 2.0 | 1.73 | 28 | Normal | 83 | 170 | 604 |

In Comparative Examples 1 to 4, the value of $P \times (D \times R)^{0.5}$ is smaller than 0.90, the end of the strip was missing, or bulging fracture occurred, so that a thin strip could not be obtained. It is speculated that the solidified shells could not be press-bonded sufficiently.

In Comparative Examples 5 to 9, the value of $P \times (D \times R)^{0.5}$ was larger than 1.30, the generation and growth of equiaxed crystals could not be sufficiently suppressed, and the columnar crystal ratio was low. Further, a large number of micropores were generated.

On the other hand, in Inventive Examples 1 to 8 in which $P \times (D \times R)^{0.5}$ was set to an appropriate range, stable casting was possible, the columnar crystal ratio was high over the entire area of the strip, and as a result, it was confirmed that the micropores were prevented.

In light of the above, with Inventive Examples, it was confirmed that it is possible to stably manufacture a thin strip having a high columnar crystal ratio over the entire area of the strip.

FIELD OF INDUSTRIAL APPLICATION

According to the present disclosure, it is possible to provide a thin strip manufacture method capable of stably manufacturing a thin strip having a high columnar crystal ratio over the entire area of the strip.

BRIEF DESCRIPTION OF THE REFERENCE SYMBOLS

1 Thin strip
3 Molten steel
5 Solidified shell
11 Cooling drum

What is claimed is:

1. A thin strip manufacture method for manufacturing a thin strip by supplying molten steel to a molten steel pool formed by a pair of rotating cooling drums and a pair of side weirs to form and grow a solidified shell on a peripheral surface of the cooling drums, wherein a pressing force P of the pair of the cooling drums is set so that the pressing force P (kgf/mm) of the pair of cooling drums, casting thickness D (mm), and radius R (m) of the cooling drums satisfy $0.90 \leq P \times (D \times R)^{0.5} \leq 1.30$ including producing the thin strip such that a minimum value of a ratio of a columnar crystal thickness to a thickness of the thin strip is over 95%, wherein the ratio of the columnar crystal thickness to the thickness of the thin strip is determined, by sampling a whole width of the thin strip and by observing a metallographic structure of a cross section in a width direction excluding 20 mm at each end.

2. A thin strip manufacture method for manufacturing a thin strip by supplying molten steel to a molten steel pool formed by a pair of rotating cooling drums and a pair of side weirs to form and grow a solidified shell on a peripheral surface of the cooling drums, the method comprising:

applying a pressing force P of the pair of the cooling drums so that the pressing force P (kgf/mm) of the pair of cooling drums, casting thickness D (mm), and radius R (m) of the cooling drums satisfy $0.90 \leq P \times (D \times R)^{0.5} \leq 1.30$ and requiring the thin strip to have a minimum value of a ratio of a columnar crystal thickness to a thickness of the thin strip over 95%, wherein the ratio of the columnar crystal thickness to the thickness of the thin strip is determined, by sampling a whole width of the thin strip and by observing a metallographic structure of a cross section in a width direction excluding 20 mm at each end.

3. The thin strip manufacture method according to claim 1, wherein, when the casting thickness D varies, the pressing force P of the pair of cooling drums is set again so as to satisfy $0.90 \leq P \times (D \times R)^{0.5} \leq 1.30$.

4. The thin strip manufacture method according to claim 2, wherein, when the casting thickness D varies, the pressing force P of the pair of cooling drums is applied again so as to satisfy $0.90 \leq P \times (D \times R)^{0.5} \leq 1.30$.

* * * * *